United States Patent [19]

Tomita

[11] Patent Number: 4,647,030

[45] Date of Patent: Mar. 3, 1987

[54] PAPER FEED APPARATUS

[75] Inventor: Hiroshi Tomita, Kyoto, Japan

[73] Assignee: Sanyo Electric Co., Ltd., Osaka, Japan

[21] Appl. No.: 654,672

[22] Filed: Sep. 26, 1984

[30] Foreign Application Priority Data

Sep. 30, 1983 [JP] Japan ..... 58-183491

[51] Int. Cl.[4] ..... B65H 3/30

[52] U.S. Cl. ..... 271/22; 271/127; 271/170

[58] Field of Search ..... 271/22, 24, 127, 170, 271/167

[56] References Cited

U.S. PATENT DOCUMENTS 3,348,838 10/1967 Springer ..... 271/24
3,497,206 2/1970 Tippy ..... 271/170
4,350,328 9/1982 Katakura ..... 271/22

FOREIGN PATENT DOCUMENTS 31830 2/1983 Japan ..... 271/167

*Primary Examiner*—Richard A. Schacher
*Attorney, Agent, or Firm*—Wenderoth, Lind & Ponack

[57] ABSTRACT

A paper feed apparatus includes, in a cassette, a separation plate mounted upright so that it is positioned close to a feed roller slightly forward thereof in the direction of paper feed, and an upper guide plate mounted so that it is positioned above a stack of papers being fed and at a level about even with the upper end of the separation plate when the forward end of the upper guide plate is pivotably moved downward. A guide plate, the position of which is adjustable according to the size of papers, partially guides the papers at one side thereof as seen in paper feed direction.

22 Claims, 10 Drawing Figures

PAPER FEED APPARATUS

BACKGROUND OF THE INVENTION

1. Field of the Invention

The present invention relates to a paper feed apparatus employed in printers, copying machines and the like, and more particularly to a paper feed apparatus for feeding paper, one sheet after another, by means of a feed roller from a cassette containing sheets of paper stacked one upon another.

2. Description of the Prior Art

In a paper feed apparatus of the type which has a cassette mounted therein that contains a stack of papers and which is adapted to feed the papers one by one by means of a feed roller, means for separating one sheet from another is conventionally in the form of separation pawls provided at corners of the leading end portion of the cassette as seen in the direction of paper feed (said leading end portion to be hereinafter referred to as "forward end").

Such arrangement is effective when papers having a predetermined size are used. If the size of the papers is changed, however, the separation pawls will not work effectively.

With a view to eliminating such drawback, the present inventor, in his Japanese patent application No. 24432 of 1983, disclosed a paper feed apparatus for feeding paper, sheet by sheet and sequentially from the uppermost sheet, by means of a feed roller from a stack of papers contained is a cassette, characterized by upwardly extending pawls bent forward in two stages at the upper end portion thereof and provided at the forward end of the cassette, and a pressure plate bent upwardly at the front end portion thereof and pivotally movable about the rear end thereof, said pressure plate being mounted in the upper front portion of the cassette so that its front end is positioned adjacent said pawls.

Such paper feed apparatus is ellustrated in FIGS. 1 to 4, inclusive. Referring to FIGS. 1 and 2, there is shown a cassette employed in the paper feed apparatus, the body of the cassette being designated by reference numeral 1. Numeral 2 is a lifting plate fitted into position on the bottom of the cassette body 1. The lifting plate 2 has projections 2*a*, 2*b* at the rear end thereof as seen in the direction of paper feed (hereinafter referred to as "rear end"), said projections 2*a*, 2*b* being loosely fitted into corresponding slots provided in the bottom of the cassette body 1 at the rear end thereof so that the lifting plate 2 is pivotable about the projections 2*a*, 2*b*. The lifting plate 2 also has a notch 3 provided at a location corresponding to that of a guide plate 8 which will hereinafter be described. Shown at 4 are separation pawls disposed upright at the inner side of the forward end of the cassette body 1. The upper end portion of each separation pawl 4 comprises an oblique portion 4*a* bent upward at a certain angle to a verticle plane, and a vertical portion 4*b* extending upright from the upward end of the oblique portion 4*a*. Both separation pawls are disposed so that the midpoint of the space between them aligns with the widthwise center of a feed roller 5 fixed to the body of the apparatus in which the cassette is mounted, and so that said midpoint is substantially laterally displaced from the center of the forward end of the cassette body 1, to the left as seen from the front side. It is noted that the term "left" (or "right"), whenever used hereinafter, refers to the left (or right) as viewed from the front side of the cassette body 1. Numeral 6 designates a pressure plate having projections 6*a*, 6*b* extending downward at both sides of its rear end and pivotally supported through said projections on side plates 1L, 1R of the cassette body 1 at respective upper portions thereof. The forward end portion of the pressure plate 6 that is not in opposed relation to the feed roller 5 is positioned adjacent the separation pawls 4, and plate 6 is spaced gradually further from the bottom of the cassette body 1 in a direction of extension away from the separation pawls 4, so that the pressure plate 6, at said forward end portion thereof, is allowed to press the papers most positively at portions thereof adjacent the separation pawls 4. The forward end portion of the pressure plate 6 includes upward bent portions 6' and a notch 7 framed at a position at which the forward end portion is opposed to the feed roller 5. Designated by numeral 8 is a guide plate for guiding stacked papers in position in the cassette body 1 and along the right side plate 1R thereof, said guide plate 8 being disposed at a location corresponding to that of the notch 3 provided in the lifting plate 2. The guide plate 8 has an L-shaped channel configuration with its horizontal portion pinned in a slit-like elongated hole 9 formed in the bottom of the cassette body 1 so that the plate 8 is slidable in the widthwise direction of the stack of papers in the cassette body 1. By changing the position of the guide plate 8 is it possible to adapt the cassette body 1 for housing therein various different sizes of paper as required.

The mode of operation of the paper feed apparatus employing the aforesaid cassette will be explained with reference to FIGS. 3 and 4.

A stack of paper 10 placed on the lifting plate 2 and, guided in position by the guide plate 8, is lifted along with the forward end of the lifting plate 2 by a lifting lever 11 which is provided in the body of the apparatus (in which the cassette body 1 is mounted) and which is extensible into the cassette body 1 under the pressing force of spring means (not shown), the uppermost one of the papers being contacted with the feed roller 5. When the feed roller 5 is rotated clockwise as viewed in FIG. 3, the uppermost sheet 12 in the stack of papers 10 is advanced, its front end being first brought into contact with the oblique portions 4*a* and then with the vertical portions 4*b* of the separation pawls. Meanwhile, the surface of the sheet 12 is pressed by the bent portions 6' of pressure plate 6.

With such arrangement, however, there is a difficulty that since the front end of the sheet 12 is caused to advance from the oblique portions 4*a* to the vertical portions 4*b* of the separation pawls while being held in contact therewith and since the surface of the sheet 12 is pressed by the bent portions 6' of the pressure plate 6, a feed error is likely to occur, if a relatively large frictional force is involved between the sheet 12 and the separation pawls 4, and more particularly between the sheet 12 and the bent portions 6' of the pressure plate 6. That is, the frictional force due to the pressure applied by the bent portions 6' of the pressure plate 6 on the sheet 12 may be greater than the force exerted by the feed roller 5 for moving the sheet 12 forward, and accordingly the sheet 12 may be prevented from being fed foward.

Another difficulty is that since the uppermost sheet 12 of the sheets contained in the cassette body 1 is supported, at its right edge side, only partially by the guide plate 8, it may be fed in an oblique posture with its rear end inclined rightward, if its condition of contact with the feed roller 5 is unbalanced about the center thereof, for example, if its portion adjacent the right side plate 1R is moved faster than the other portion.

A further difficulty is that, as the papers in the cassette run short, two or more sheets of paper are likely to be fed at a time. That is, when the stack of papers 10 is thinned to the extent that only a few sheets are left, the lifting plate 2 is raised and the lifting force of the lifting lever 11 is weakened. Consequently, the frictional force between the lifting plate 2 and the lowermost sheet in contact therewith becomes smaller than the frictional force between the lowermost sheet and the immediate next upper sheet or sheets, and thus all the remaining sheets of the stack of papers 10 are fed at the same time. Such phenomenon is most likely to occur when two or three sheets of paper are left of a stack of papes 10.

OBJECT OF THE INVENTION

The present invention is directed toward overcoming the aforesaid difficulties. Accordingly, it is a primary object of the invention to provide a paper feed apparatus which permits accurate feeding of paper, sheet by sheet and in perfectly separated condition.

It is a second object of the invention to provide a paper feed apparatus which is free from the possibility of two or more sheets being fed at a time even where the number of sheets contained in a cassette is relatively small.

It is a third object of the invention to provide a paper feed apparatus which permits feeding of stacks of papers of various sizes from one cassette.

It is a fourth object of the invention to provide a paper feed apparatus which eliminates the possibility of papers being fed obliquity even where stacks of papers of various sizes are to be fed.

It is a fifth object of the invention to provide a paper feed apparatus which permits easy setting of papers into a cassette.

The above and further objects and features of the invention will more fully be apparent from the following detailed description with reference to the accompanying drawings.

DETAILED DESCRIPTION OF THE INVENTION

Figure 1:
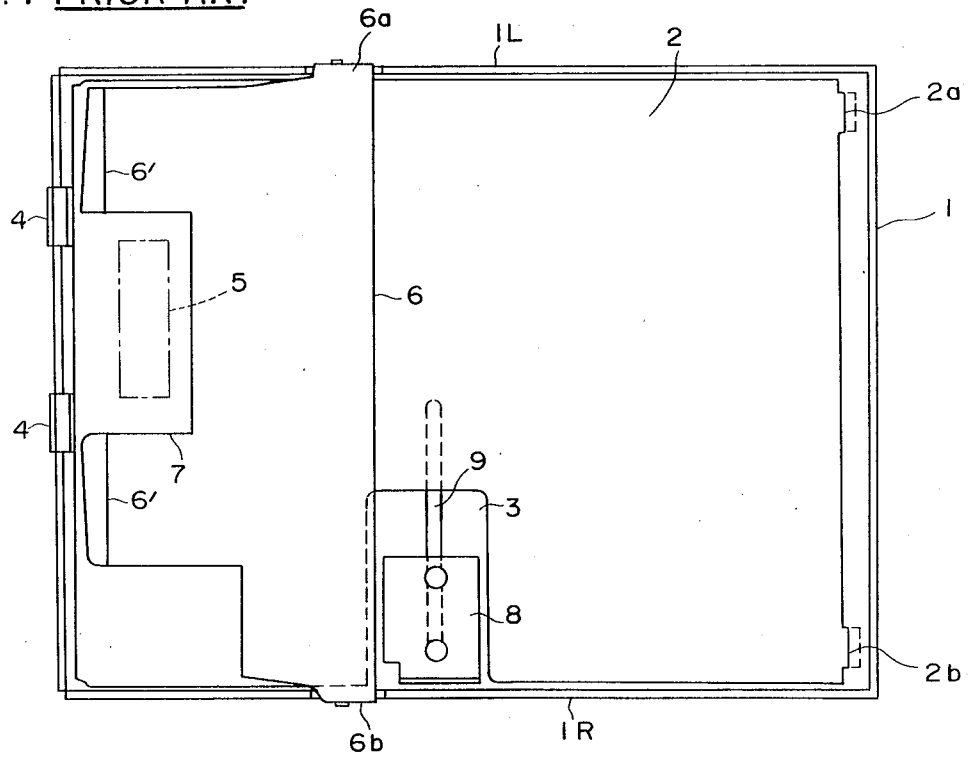
FIG. 1 PRIOR ART
FIG. 1 is a plan view of a cassette of a conventional paper feed apparatus.
Figure 2:
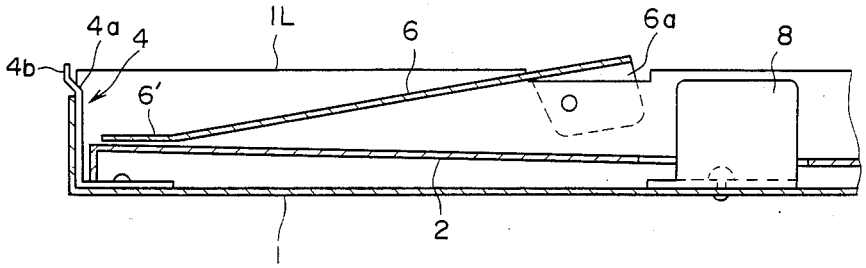
FIG. 2 PRIOR ART
FIG. 2 is a fragmentary sectional view thereof.
Figure 3:
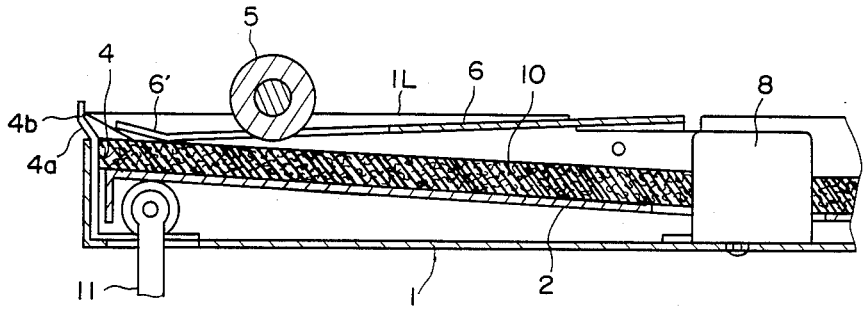
FIG. 3 PRIOR ART
FIG. 3 is a sectional view of the cassette as mounted in the paper feed apparatus.
Figure 4:
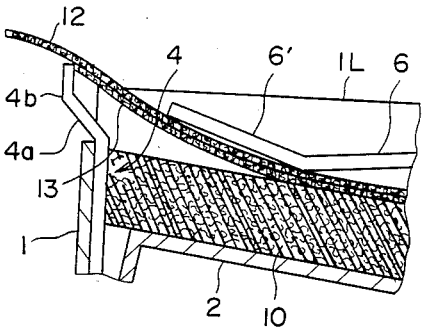
FIG. 4 PRIOR ART
FIG. 4 is a fragmentary enlarged view thereof.
Figure 5:
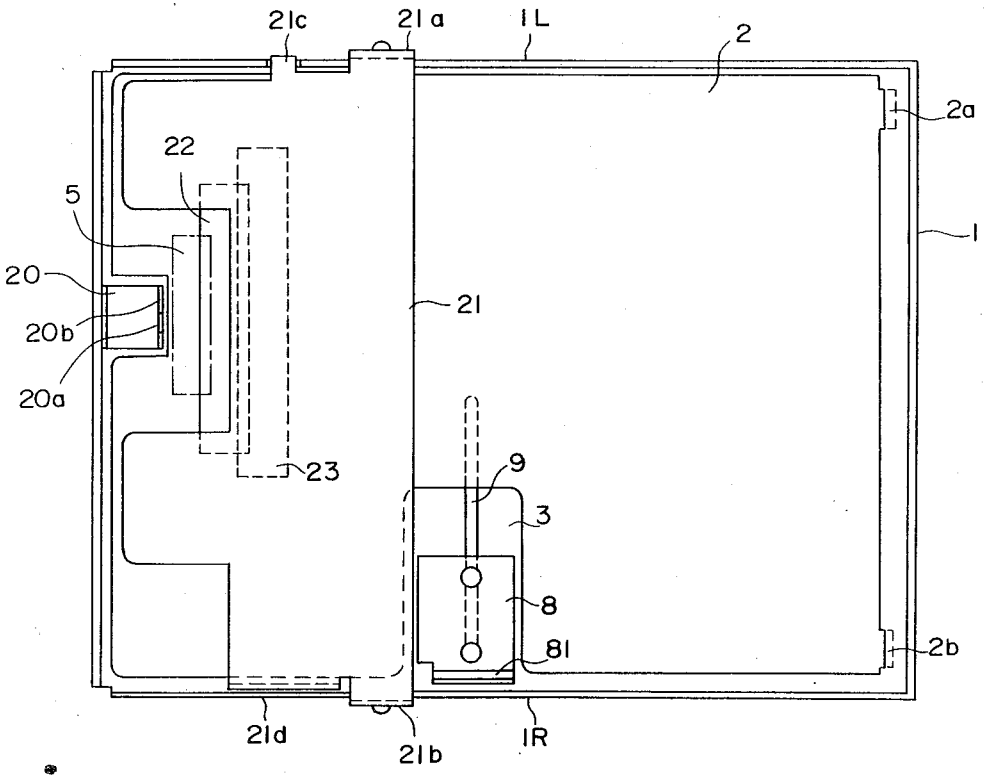
FIG. 5 is a plan view of a cassette employed in a paper feed apparatus of the invention.
Figure 6:
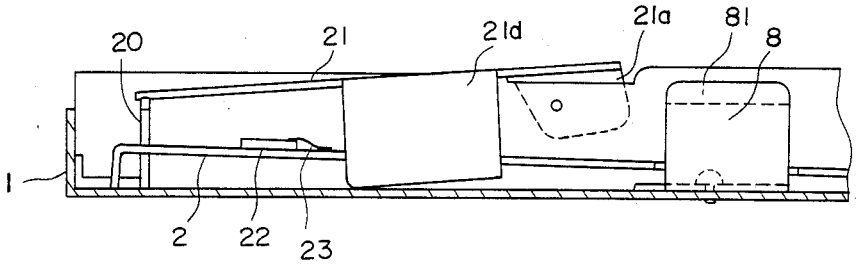
FIG. 6 is a fragmentary sectional view thereof.
Figure 7:
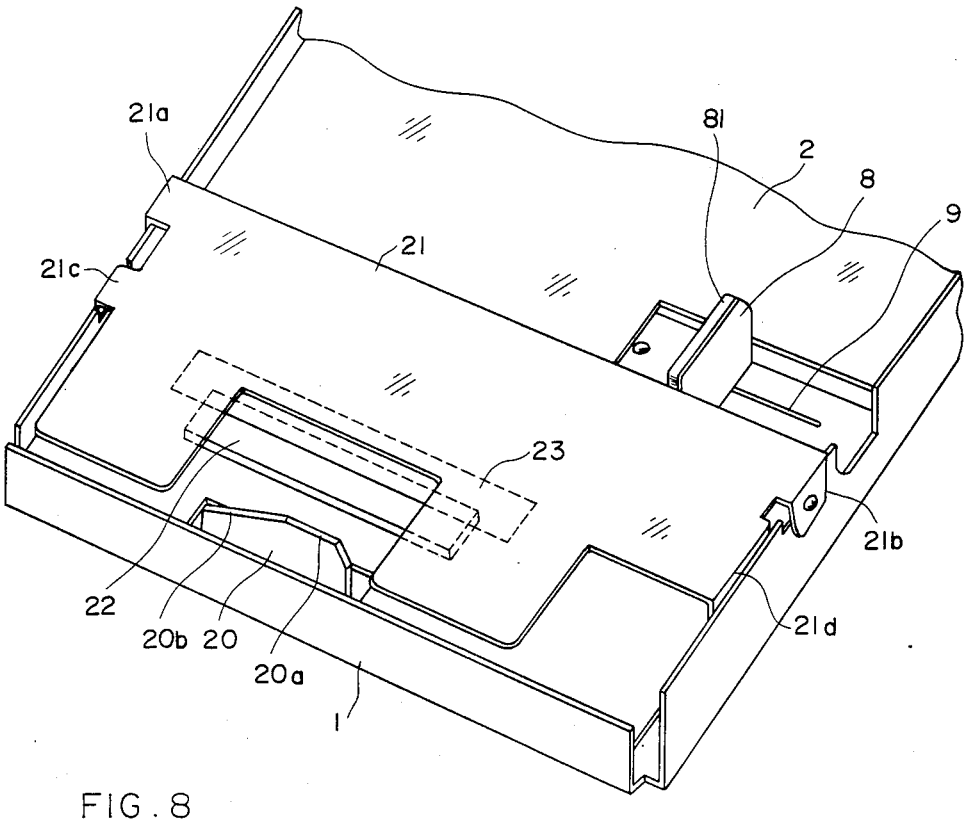
FIG. 7 is a perspective view thereof.
Figure 8:
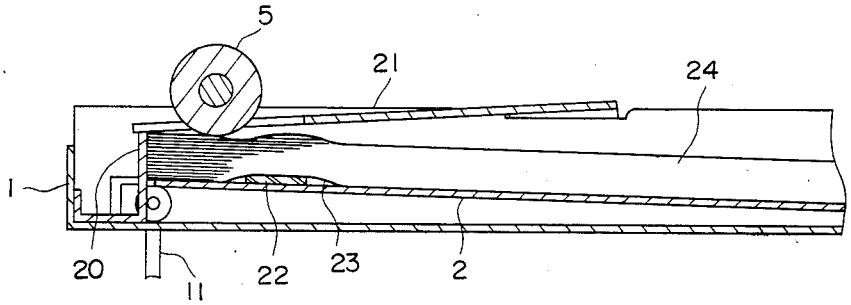
FIG. 8 is a sectional view of the cassette as mounted in the paper feed apparatus of the invention.

The paper feed apparatus of the invention will now be described with reference to FIGS. 5 to 10, inclusive.

In the drawings, numeral 1 designates a cassette body constructed of stainless steel or synthetic resin and having a shallow box shape. Numeral 2 is a lifting plate fitted in position on the bottom of the cassette body 1. The lifting plate 2 has projections 2*a*, 2*b* formed at its rear end, said both projections 2*a*, 2*b* being loosely fitted in two slots provided at the rear end of the bottom of cassette body 1 so that the lifting plate 2 is pivotable about the projections 2*a*, 2*b*. The lifting plate 2 also has a notch 3 formed at a location corresponding to that of a guide plate 8. The guide plate 8 is disposed correspondingly to the notch 3 of the lifting plate 2 so as to guide the right side of papers stacked up in the cassette body 1. The guide plate 8 has an L-shaped channel configuration and has two pins fixed to its horizontal portion, said pins being passed through a slit-like elongate hole 9 formed in the bottom of the cassette body 1 so that the guide plate 8 is slidable transversely (i.e. in the widthwise direction of the sheets).

Further, the guide plate 8 has a belt-shaped projection 81 provided inside the upper edge thereof, whereby papers can positively be prevented from surmounting the upper edge of the guide plate 8, if they are bent up-and-downwardly or irregularly positioned. It is noted that the projection 81 may be fitted with a rubber piece or the like or may be formed by bending inwardly the upper edge of the guide plate 8.

Designated by numeral 20 is a separation plate made of hard metal such as stainless steel or the like. Medially at its upper end portion, the separation plate 20 has a horizontal portion 20*a* formed linearly and which is parallel with and at a level slightly higher than the surface of a stack of papers 24 contained in the cassette body 1 when mounted in the body of the apparatus. The separation plate 20 is disposed upright in the cassette body 1 so that its upper end is positioned close to and slightly frontwardly of a feed roller 5 mounted on the paper feed apparatus of the invention as attached to a printer or copying machine, when the cassette body 1 is mounted in the paper feed apparatus of the invention, and so that the horizontal portion 20*a* is positioned parallel to the rotation axis of the feed roller 5. The midpoint of the horizontal portion 20*a* is located slightly rightwardly of the width-wise center of the feed roller 5. Further, the upper end portion of the separation plate 20 includes a slanted portion 20*b* formed on its corner edge portion facing the left side, said slanted portion 20*b* having a downward inclination of 10°-20° relative to the horizontal portion 20*a*. Said upper end portion includes another slanted portion formed on its corner edge portion facing the right side, said slanted portion being intended to protect papers from being damaged. However, this latter mentioned slanted portion is not always necessary. What is important is that the horizontal portion 20*a* must be laterally asymmetrical relative to the widthwise center of the feed roller 5. By virtue of such construction of the separation plate 20, the underside of each paper fed forward by the feed roller 5 is subjected to larger frictional force on its portion on the guide plate 8 side (its right portion) of the width-wise center of the feed roller 5.

In this connection, it is noted that if a separation plate 20 is produced by punching, the plate 20, after deburring, should preferably be so mounted as to have its deburred surface positioned to face a stack of papers 24. The reason is that if the opposite side is positioned to face the stack of papers 24, two or more sheets are likely to be fed forward because of a certain press-cutting scar left on the curved edge of the separation plate 20 with which the uppermost sheets of the stack 24 contact.

The angle of the separation plate 20 to the bottom of the cassette body 1 is preferably slightly smaller than 90° (e.g. 88°-89°) on the side facing the stack of papers 24. The reason is that since papers are fed forward in a slightly upward relation to the bottom plate of the cassette body 1, sheets other than the uppermost sheet can be positively retained in position by having the separation plate 20 slightly inclined toward the stack of papers 24.

Figure 9:
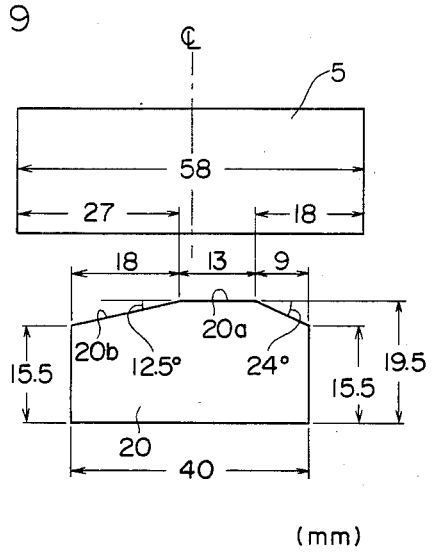
FIG. 9 is an actual dimensional diagram showing, by way of example, relative positions of a feed roller and a separation plate in the paper feed apparatus of the invention, as viewed in a direction orthogonal to the direction of paper feed.
Figure 10:
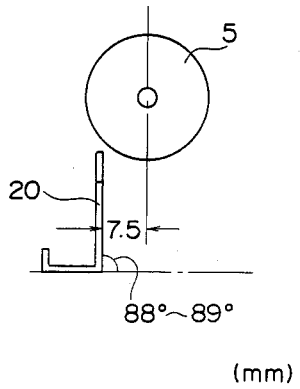
FIG. 10 is an actual dimensional diagram showing their relative positions as seen in the direction of paper feed.

FIGS. 9 and 10 are actual dimensional diagrams showing, by way of example, relative positions of various parts of the separation plate 20 and the feed roller 5 in the paper feed apparatus of the invention. (It is noted, however, that the relative positions of the separation plate 20 and the feed roller 5 in the vertical direction as shown in FIG. 9 are different from actual positions.) It may be readily understood from FIGS. 9 and 10 that the horizontal portion 20*a* of the separation plate 20 is positioned rightwardly of the center line of the feed roller 5 (FIG. 9) and that the upper end of the separation plate 20 is positioned close to the feed roller 5 (FIG. 10).

Numeral 21 is an upper guide plate which, at projections 21*a*, 21*b* extending downwardly at both sides of the rear end thereof, is pivotally supported on respective upper portions of side plates 1L,1R of the cassette body 1 and at a location frontward of the guide plate 8. The upper guide plate 21 has a projection 21*c* provided on the left side and engageable with the upper portion of the left side plate 1L. The plate 21 also has a bent portion 21*d* provided on the right side and extending downward and contacting the bottom plate of the cassette body 1. By virtue of the projection 21*c* and bent portion 21*d*, the underside of the forward end of upper guide plate 21 is at a substantially even level with or at a slightly lower level than the upper end of separation plate 20. Shown by 22 is a friction sheet fixed on the lifting plate 2 slightly rearwardly of a location opposed to the feed roller 5. The friction sheet 22 is a rectangular rubber sheet having a thickness of about 0.5 mm. Numeral 23 is an thin polyester film which is fixed on the lifting plate 2 and on top of the rear portion of the friction sheet 22 so that the vicinity of the boundary between the rear end portion of said friction sheet 22 as seen in the direction of paper feed and lifting plate 2 is covered by a thin polyester film 23.

According to such construction, a stack of papers 24 is housed in the cassette body 1 by being inserted from the rear end of the cassette body 1 into the space between the lifting plate 2 and the upper guide plate 21. The projection 21*c* and bent portion 21*d* of the upper guide plate 21 provide a space between the upper guide plate 21 and the lifting plate 2, which space permits easy insertion of the stack of papers 24 between the lifting plate 2 and the upper guide plate 21. The thin polyester film 23 fixed over the rear portion of the friction sheet 22 prevents formation of a step between the lifting plate 2 and the friction sheet 22, so that a stack of papers 24 can be smoothly inserted with its lowermost sheets not being caught by the friction sheet 22. Instead of fixing the thin polyester film 23, the friction sheet 22 may be gently rounded or slanted at the rear end portion thereof, in which case the above described effect can be achieved as well.

The operation of the paper feed apparatus of the invention will be explained. A stack of papers 24 is inserted into the space between the lifting plate 2 and the upper guide plate 21, and then the guide plate 8 is moved toward the stack of papers 24 and is fixed in position when it contacts the stack of papers 24 lightly. The cassette body 1 in which the stack of papers 24 is so housed is mounted in the body of the apparatus (for example a copying machine or printer). The stack of papers 24 thus placed on the lifting plate 2 is guided at its right side by the guide plate 8. By the belt-like projection 81 attached to the inner side of the upper edge of the guide plate 8, sheets are prevented from being fed forward in a bent condition or from surmounting the guide plate 8 when the uppermost sheets of the stack of papers 24 are irregularly positioned at the right side.

Thus, the stack of papers 24 placed on the lifting plate 2 is lifted together with the lifting plate 2 by a lifting lever 11 which is mounted on the body of the apparatus and which is allowed to extend into the cassette body 1 by spring force, so that the upper most sheet of the stack of papers 24 is brought into contact with the feed roller 5. As the feed roller 5 is rotated clockwise, the uppermost sheet is fed forward and, since its forward end is in contact with the separation plate 20, the sheet may behave as if it would bend upward at a medial portion thereof. However, by virtue of the upper guide plate 21 and feed roller 5, positioned close to each other rearwardly of the separation plate 20, such upwardly bending behavior is prevented. As the feed roller 5 further rotates, the front end of the sheet is allowed to jump upward to surmount the separation plate 20 so that the sheet is fed while being held in contact at its underside with the separation plate 20. Since the separation plate 20 has a slanted portion 20*b* so that its horizontal portion 20*a* is laterally asymmetrical relative to the center line of the feed roller 5, the underside of the sheet is subjected to large frictional force through positive contact with the horizontal portion 20*a* located rightwardly of the center line of the feed roller 5. Accordingly, the sheet might behave as if it would advance in such a way that its left-side portion would go ahead of its right-side portion. However, the stack of papers 24 is in contact at its left side with the inner side of left side plate 1L of the cassette body 1, and therefore, papers are prevented from being fed forward obliquely.

Where the conventional apparatus is employed, depending upon the condition of contact between the uppermost sheet and the feed roller 5, the sheet may advance in such a manner that its left-side portion goes ahead of its right-side portion, or vice versa. If the right-side portion tends to go ahead, the sheet is fed forward obliquely notwithstanding the fact that the sheet is guided at its right side by the guide plate 8, because the sheet is only partially so guided at its right side. According to the present invention, however, a paper being fed is subjected to large frictional force on the guide plate 8 side rather than at a center portion of the feed roller 5, and therefore, each paper is inclined to advance in such a way that its left-side portion which is in contact with the left side plate 1L of the cassette body 1 would go ahead, which fact positively prevents feeding at an oblique posture of the paper.

The upper guide plate 21 has its forward end positioned at a level substantially even with the uppermost end of separation plate 20 through the projection 21*c* and bent portion 21*d*. Accordingly, upwardly bending movement of papers can be prevented, and thus papers can be accurately fed forward. Further, the upper guide plate 21 will never press papers downward in any positive way. Therefore, the paper-forwarding force of the feed roller 5 will never be reduced, and thus the problem of non-feed of papers can be positively prevented.

Furthermore, by virtue of the friction sheet 22 fixed on the lifting plate 2 to cover the vicinity of the boundary between the rear end portion of the friction sheet 22 and lifting plate 2, the frictional force between the lower-most sheet and the lifting plate 2 can be positively maintained even when the stack of papers 24 runs short, because proper frictional force is maintained between the lower-most sheet and sheets present thereabove. Thus, papers can be accurately separated and fed forward without even one sheet of paper being left over.

In the above described embodiment, the friction sheet 22 is applied in such a way that it will never contact the feed roller 5. Therefore, if the feed roller 5 is rotated in the absence of a stack of papers 24, the feed roller 5 wil never be worn out.

As this invention may be embodied in several forms without departing from the spirit of essential characteristics thereof, the present embodiment is therefore illustrative and not restrictive, sinch the scope of the invention is defined by the appended claims rather than by the description preceding them, and all changes that fall within the meets and bounds of the claims, or equivalents of such meets and bounds thereof, are therefore intended to be embraced by the claims.

What is claimed is:

1. In a paper feed apparatus for feeding paper sheets one at a time from the top of a stack of paper sheets, said apparatus being of the type including a cassette having a pivotally mounted lifting plate for supporting thereon a stack of paper sheets, a feed roller for feeding said sheets one at a time in a feed direction from said cassette, and means for pivoting upwardly a forward end, with respect to said feed direction, of said lifting plate and said stack of paper sheets supported thereby, thereby bringing the uppermost paper sheet of said stack into contact with said feed roller, the improvement comprising means for preventing feeding of plural sheets at a time from said stack and feeding of said sheets while oriented obliquely of said feed direction, said preventing means comprising:

an upwardly extending separation plate positioned adjacent said feed roller at a location forwardly thereof with respect to said feed direction, for abutting forward ends of all of said sheets of said stack at a position between lateral edges thereof, said separation plate having an upper end extending to a level above the topmost sheet of said stack; and an upper guide plate pivotally mounted at a rear end thereof and having a forward end and means for maintaining an undersurface of said forward end at a level substantially equal to said level of said upper edge of said separation plate and such that said forward end is prevented from pressing the uppermost sheet of said stack.

2. The improvement claimed in claim 1, further comprising a friction sheet positioned on the upper surface of said lifting plate at a position slightly rearwardly of said feed roller with respect to said feed direction, said friction sheet having a coefficient of friction greater than that of said upper surface of said lifting plate.

3. The improvement claimed in claim 2, wherein the rear end of said friction sheet with respect to said feed direction, is inclined or rounded.

4. The improvement claimed in claim 2, further comprising a thin film covering the vicinity of a boundary between the rear end of said friction sheet, with respect to said feed direction, and said lifting plate.

5. The improvement claimed in claim 1, wherein said separation plate has a rear surface, with respect to said feed direction, extending at an angle of less than 90° with respect to a bottom of said cassette.

6. The improvement claimed in claim 1, further comprising a lateral guide plate mounted on said cassette for adjustment in a direction orthogonal of said feed direction for guiding a first side of said stack, and a fixed side wall of said cassette for guiding a second side of said stack.

7. The improvement claimed in claim 6, wherein said lateral guide plate has at an upper end thereof means for preventing sheets of said stack from surmounting said lateral guide plate.

8. The improvement claimed in claim 6, wherein said upper edge of said separation plate includes means for imparting to the undersurface of an uppermost said sheet being fed, at a side thereof toward said lateral guide plate, a greater friction force than to said undersurface at a location thereof aligned with the widthwise center of said feed roller.

9. The improvement claimed in claim 8, wherein said friction force imparting means comprises a first portion of said upper edge of said separation plate contacting said undersurface, said upper edge first portion being positioned laterally asymmetrical relative to said widthwise center of said feed roller.

10. The improvement claimed in claim 9, wherein said upper edge of said separation plate comprises a second portion inclined downwardly from said first portion in a direction toward said fixed side wall.

11. The improvement claimed in claim 6, further comprising a friction sheet positioned on the upper surface of said lifting plate at a position slightly rearwardly of said feed roller with respect to said feed direction, said friction sheet having a coefficient of friction greater than that of said upper surface of said lifting plate.

12. The improvement claimed in claim 11, wherein the rear end of said friction sheet with respect to said feed direction, is inclined or rounded.

13. The improvement claimed in claim 11, further comprising a thin film covering the vicinity of a boundary between the rear end of said friction sheet, with respect to said feed direction, and said lifting plate.

14. The improvement claimed in claim 6, wherein said separation plate has a rear surface, with respect to said feed direction, extending at an angle of less than 90° with respect to a bottom of said cassette.

15. In a paper feed apparatus for feeding paper sheets one at a time from the top of a stack of paper sheets, said apparatus being of the type including a cassette having a pivotally mounted lifting plate for supporting thereon a stack of paper sheets, a feed roller for feeding said sheets one at a time in a feed direction from said cassette, and means for pivoting upwardly a forward end, with respect to said feed direction, of said lifting plate and said stack of paper sheets supported thereby, thereby bringing the uppermost paper sheet of said stack into contact with said feed roller, the improvement comprising means for preventing feeding of plural sheets at a time from said stack and feeding of said sheets while oriented obliquely of said feed direction, said preventing means comprising:

an upwardly extending separation plate positioned adjacent said feed roller at a location forwardly thereof with respect to said direction, for abutting forward ends of all of said sheets of said stack at a position between lateral edges thereof, said separation plate having an upper end extending to a level above the topmost sheet of said stack;

an upper guide plate pivotally mounted at a rear end thereof and having a forward end and means for maintaining an undersurface of said forward end at a level substantially equal to said level of said upper edge of said separation plate;

a lateral guide plate mounted on said cassette for adjustment in a direction orgthogonal of said feed direction for guiding a first side of said stack, and a fixed side wall of said cassette for guiding a second side of said stack; and said upper edge of said separation plate including means for imparting to the undersurface of an uppermost said sheet being fed, at a side thereof toward said lateral guide plate, a greater friction force than to said undersurface at a location thereof aligned with the widthwise center of said feed roller.

16. The improvement claimed in claim 15, wherein said friction force imparting means comprises a first portion of said upper edge of said separation plate contacting said undersurface, said upper edge first portion being positioned laterally asymmetrical relative to said widthwise center of said feed roller.

17. The improvement claimed in claim 16, wherein said upper edge of said separation plate comprises a second portion inclined downwardly from said first portion in a direction toward said fixed side wall.

18. The improvement claimed in claim 15, wherein said lateral guide plate has at an upper end thereof means for preventing sheets of said stack from surmounting said lateral guide plate.

19. The improvement claimed in claim 15, further comprising a friction sheet positioned on the upper surface of said lifting plate at a position slightly rearwardly of said feed roller with respect to said feed direction, said friction sheet having a coefficient of friction greater than that of said upper surface of said lifting plate.

20. The improvement claimed in claim 19, wherein the rear end of said friction sheet with respect to said feed direction, is inclined or rounded.

21. The improvement claimed in claim 19, further comprising a thin film covering the vicinity of a boundary between the rear end of said friction sheet, with respect to said feed direction, and said lifting plate.

22. The improvement claimed in claim 15, wherein said separation plate has a rear surface, with respect to said feed direction, extending at an angle of less than 90° with respect to a bottom of said cassette.

* * * * *